United States Patent [19]

Szafianski

[11] 4,088,316

[45] May 9, 1978

[54] DEPRESSURIZED TETHERED TENNIS BALL TRAINING DEVICE

[76] Inventor: Marius Szafianski, 230 E. 79th St., Apt. 7C, New York, N.Y. 10021

[21] Appl. No.: 686,051

[22] Filed: May 13, 1976

[51] Int. Cl.[2] ..... A63B 69/38

[52] U.S. Cl. ..... 273/29 A; 273/58 C; 273/58 B; 273/DIG. 26

[58] Field of Search ..... 272/77; 273/29 A, 26 E, 273/26 EA, 95 A, 95 AA, 58 C, 200 R, 200 A, 200 B, 58 R, 58 B, 58 C, 58 D, 61 B

[56] References Cited

U.S. PATENT DOCUMENTS

| | | | |
|---|---|---|---|
| 831,605 | 9/1906 | Doyle | 273/26 E |
| 1,105,329 | 7/1914 | Kleinschmidt | 273/26 E |
| 1,554,409 | 9/1925 | Coffee | 273/26 E |
| 2,045,972 | 6/1936 | Tompkins | 272/77 |
| 2,247,072 | 6/1941 | Stow | 273/29 A |
| 2,751,226 | 6/1956 | Conway | 273/95 A X |
| 2,785,643 | 1/1974 | Rich | 273/58 C |
| 3,397,887 | 8/1968 | Caplin | 272/77 |
| 3,825,259 | 7/1974 | Burchett | 273/29 A |

FOREIGN PATENT DOCUMENTS

| | | | |
|---|---|---|---|
| 505,719 | 5/1939 | United Kingdom | 272/78 |

*Primary Examiner*—Richard C. Pinkham
*Assistant Examiner*—T. Brown
*Attorney, Agent, or Firm*—Haseltine, Lake & Waters

[57] ABSTRACT

A tennis training or exercising device in which a depressurized tennis ball is provided with an opening communicating with the interior and exterior of the ball, to allow air to pass freely from the interior of the ball when the latter is struck. A flexible cord is connected to the ball and has one end connected to the ceiling through a pressure-sensitive hook, and the other end connected to a standing weight which is placed on the floor. The passage of air from the interior of the ball to the exterior thereof, permits the ball to oscillate in a controlled manner after being struck. A counter arrangement at the bottom of the cord, will count only correctly applied strokes to the ball.

8 Claims, 5 Drawing Figures

DEPRESSURIZED TETHERED TENNIS BALL TRAINING DEVICE

BACKGROUND OF THE INVENTION

This invention relates to a device for practicing tennis strokes with a regular tennis racket. An object of this invention is to provide means for practicing tennis strokes, especially in limited indoor space such as a standard living room or basement.

Another object of this invention is to provide a device as described which is constructed with a very few and simple parts, is very easy to install and is yet a device which brings to perfection many elements necessary for a good tennis play such as quick response, strong grip, striking with the correct spot of a tennis racket, etc.

Another object of this invention is to provide a device which corrects strokes performed in a wrong way, e.g., off center of a tennis racket.

It is still another object of the present invention to provide a device which, while training the proper technique, results in conditioning and exercising at the same time of the particular group of muscles used during a regular tennis game, which due to a considerable physical effort, is necessary for a proper use of the device.

In the past, such devices have been made very often with regular, inflated tennis ball having strong bounce required and desirable for regular outdoor tennis game. Such balls were very difficult to control when used for indoor tennis training devices.

It has been found, surprisingly, that when regular tennis ball is perforated and depressurized, such a ball shows a number of new qualities particularly useful for limited space training devices. The bounce is subdued yet ball saves all other tennis ball features such as weight, size, appearance etc. Air motion in and out of the perforated ball takes a lot of impact energy and that diminishes uncontrolable bounce yet requires more of physical effort to keep ball in constant oscillation.

BRIEF DESCRIPTION OF THE DRAWINGS

Although such novel feature or features believed to be characteristic of the invention are pointed out in the claims, the invention and the manner in which it may be carried out, may be further understood by reference to the description following and the accompanying drawings.

DESCRIPTION OF THE PREFERRED EMBODIMENTS

Referring now to the figures in greater detail, where like reference numbers denote like parts in the various figures.

Figure 1:
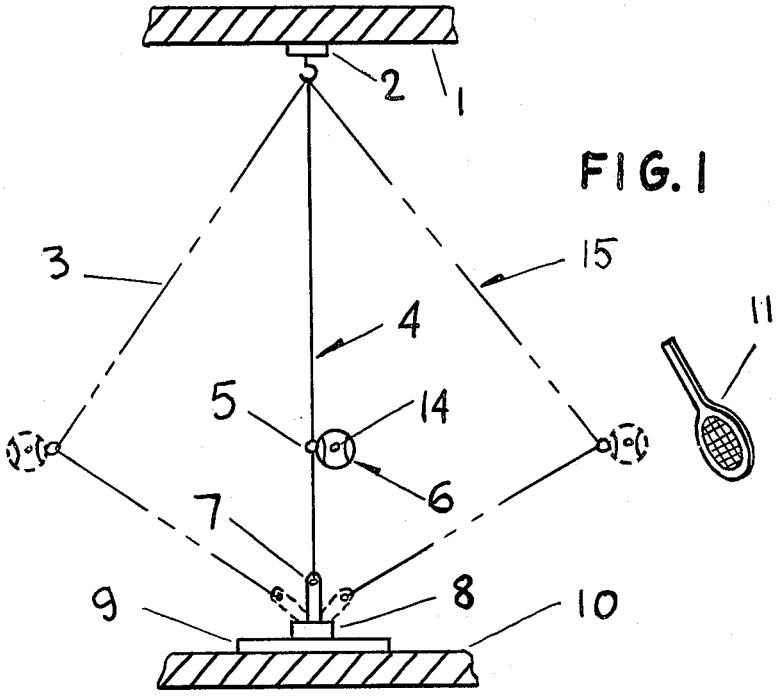
FIG. 1 is an elevation of the primary embodiment.

The device 15 comprises string 4 and the ball 6 as shown in FIG. 1. The upper end of springy, elastic string or web 4 is vertically attached to a self-adhering hook 2 attached to a ceiling 1 for support. The lower end of the string 4 is attached to the arm 7 which is attached to a counter 8 counting a number of successful strokes. The counter 8 is moved by ball 6 oscillations and it is an integral part of free standing weight 9 lying on the floor 10.

The elastic string can be made of any elastomeric material such as natural rubber, synthetic rubber or it can be made in some embodiments, the details of which are not shown, of steel spring.

The best results can be achieved with an elastic string made of high tensile strength, high elongation rubber with cross-sectional area of 0.001 sq. inch to 1/64 sq. inch length 5 ft. to 20 ft. and tension applied to allow oscillation within 30 ft. for an average stroke. The ball 6 is fitted with a loop 5 for attaching to a elastic string 4 and a perforation 14 to increse control of a bouncing ball. Perforation surface area defines the bounce of a tennis ball. One hole ⅛ of an inch diameter in a regular tennis ball results in more bounce and less control than two holes ⅛ of an inch diameter. Usually two holes ⅛ of an inch are giving the optimum of properties.

The length of the elastic string 4 is shorter than the distance between hooks 2 and 7, so that the elastic string is being extended between two hooks with a depressurized tennis ball in the middle of it.

In order to use the device, one stands in front of the ball 6, slightly to the right or to the left for backhand (or forehand) strokes and then one strikes the ball 6 with the tennis racket 11, or other suitable instrument.

Depending on the strength of a stroke and its direction, the ball goes forward and then returns for a next stroke. Any fault which consists of a stroke too weak or poorly directed, results in a ball which is almost impossible to strike again. This principle encourages powerful and sound strokes with the "sweet spot" of a tennis racket. The ball comes within one second intervals and that assures a considerable physical effort even within a few minutes of training. The degree of tension in the string 4 and total perforation area in the ball 6 control speed and direction of an oscillating ball.

Figure 2:
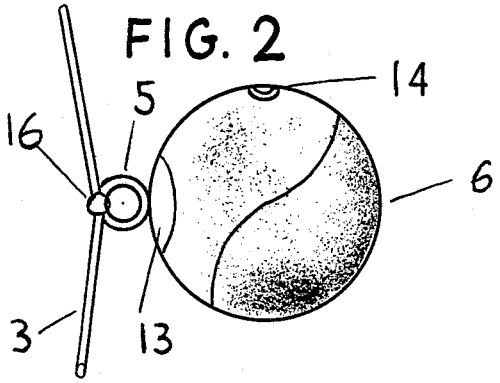
FIG. 2 is a perforated and depressurized tennis ball with one configuration of a holding means.

The one configuration of the holding means is shown in FIG. 2. The loop 5 is put together with the tennis ball 6 with adhesive adhering pad 13. The elastic string 4 is attached to the loop 5 with the knot 16. The hole 14 allows free air motion in and out during the moment of impact.

Figure 3:
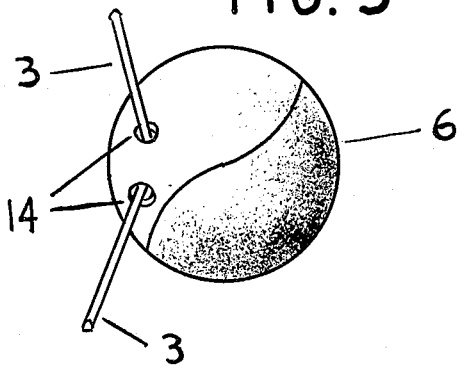
FIG. 3 is a perforated and depressurized tennis ball with a holding means being at the same time air motion system holes.

FIG. 3 shows another embodiment of the device. There are two holes 14 in the tennis ball 6. These holes are at the same time holding means for string 3 going through the ball.

The diameter of holes 14 is larger than diameter of the elastic web 3 so that there is enough space left to allow free air movement during the moment of impact.

Figure 4:
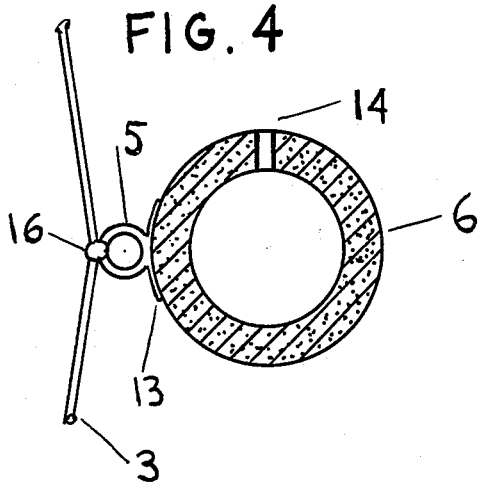
FIG. 4 is a cross-section of a ball shown in FIG. 2.

FIG. 4 shows a cross-section of the embodiment described in FIG. 2.

Figure 5:
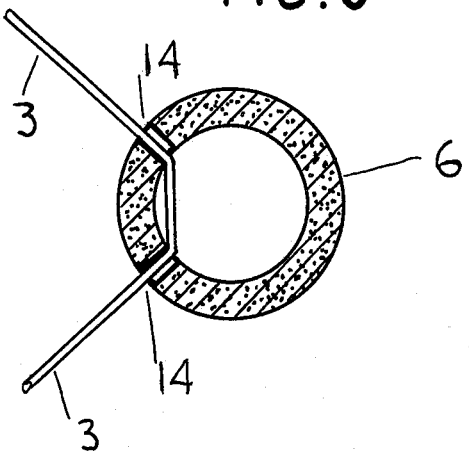
FIG. 5 is a cross-section of a ball shown in FIG. 3.

FIG. 5 shows a cross-section of the embodiment described in FIG. 3.

The terms and expressions which are employed are used as terms of description; it is recognized, though, that various modifications are possible within the scope of the invention claimed.

Having thus described certain forms of the invention in some detail, what is claimed is:

1. A tennis training device supported between upper and lower supports comprising: a depressurized tennis ball with at least one opening communicating with the interior and exterior of said tennis ball, air escaping from the interior of said ball to the exterior thereof when said ball is struck; a flexible elastic string member connected to said ball and having one of its ends connected to, said upper support and its other end connected to said lower support, said ball being connected to said flexible member at a point between said upper and lower supports, said ball and flexible elastic member oscillating when said ball is struck; said lower support including means for counting strokes only when said ball is struck to move in a pre-determined direction for registering only correctly applied strokes, air passing through said opening from the interior of said ball when struck is functional in limiting controlably the oscillation of said ball.

2. The tennis training device as defined in claim 1 including adhesive means for connecting said tennis ball to said flexible member.

3. The tennis ball training device as defined in claim 1 wherein said upper support comprises the ceiling of an interior space housing said training device.

4. The tennis ball training device as defined in claim 3 including self-adhesive hook means connecting said one end to said ceiling.

5. The tennis ball training device as defined in claim 4 wherein said means for counting strokes include a free standing weight positioned on the floor of said interior space housing said training device.

6. The tennis ball training device is defined in claim 5 wherein said flexible elastic member is comprised of rubber-like material having a cross-sectional area between substantially 0.001 square inch to 1/64 square inch and having a total length of substantially 5 feet to 10 feet, said self-adhesive hook means comprising a pressure-sensitive hook.

7. The tennis ball training device as defined in claim 1 wherein in said means for counting strokes only when said ball is struck in a predetermined direction comprises counter means with an actuating arm movable only in a predetermined direction.

8. The tennis ball training device as defined in claim 1 wherein said tennis ball has two openings with axes subtending an acute central angle with respect to the center of said ball, said flexible elastic member passing through said two openings, said flexible member being a continuous member having a diameter substantially smaller than the diameter of said openings so that air may pass freely from within the interior of said ball to the exterior thereof.

* * * * *